US005560123A

United States Patent [19]

Eskelinen

[11] Patent Number: 5,560,123

[45] Date of Patent: Oct. 1, 1996

[54] METHOD AND DEVICE FOR ENSURING THE RUN OF THE WEB IN THE MULTI-CYLINDER DRYER OF A PAPERMACHINE

[75] Inventor: Pekka Eskelinen, Kotka, Finland

[73] Assignee: Valmet Paper Machinery Inc., Helsinki, Finland

[21] Appl. No.: 318,878

[22] PCT Filed: Feb. 19, 1993

[86] PCT No.: PCT/FI93/00057

§ 371 Date: Oct. 18, 1994

§ 102(e) Date: Oct. 18, 1994

[87] PCT Pub. No.: WO94/19535

PCT Pub. Date: Sep. 1, 1994

[51] Int. Cl.[6] ..... D06F 58/00; F26B 11/02; F26B 5/04

[52] U.S. Cl. ..... 34/414; 34/117; 34/454; 34/455

[58] Field of Search ..... 34/117, 120, 644, 34/654, 414, 454, 455

[56] References Cited

U.S. PATENT DOCUMENTS

| | | | |
|---|---|---|---|
| 3,753,298 | 8/1973 | Ely | 34/116 |
| 4,602,439 | 7/1986 | Eskelinen | 34/116 X |
| 4,953,297 | 9/1990 | Eskelinen et al. | 34/116 X |
| 4,967,489 | 11/1990 | Autio | 34/116 |
| 5,101,577 | 4/1992 | Wedel | 34/117 |
| 5,230,168 | 7/1993 | Heinzmann et al. | 34/120 |
| 5,238,535 | 8/1993 | Kraft | 162/193 |
| 5,325,608 | 7/1994 | Mayer | 34/120 |

FOREIGN PATENT DOCUMENTS

| | | |
|---|---|---|
| 68279 | 4/1985 | Finland . |
| 76142 | 5/1988 | Finland . |
| 854494 | 5/1988 | Finland . |

*Primary Examiner*—John M. Sollecito
*Assistant Examiner*—Steve Gravini
*Attorney, Agent, or Firm*—Pollock, Vande Sande & Priddy

[57] ABSTRACT

The multi-cylinder dryer of a papermachine comprises a first tier of cylinders, wherein a web travels supported by a first dryer wire on the cylinders of the first tier of cylinders, as well as a second tier of cylinders, wherein the web travels supported by a second dryer wire on the cylinders of the second tier of cylinders. Upon passing around its wire guide roll, each dryer wire forms a loop having at least one section, along which the first or second wire, respectively, is free from the web and which in this wire traveling direction is immediately upstream of a point, at which the first or second wire is received on the first or second guide roll. Along a wire section between a cylinder and the guide roll, a nozzle inside the respective wire loop is used blowing air through the free section of dryer wire into a pocket between it and a cylinder of the opposite tier of cylinders for ventilating the pocket through a plenum zone formed between an air guiding surface located inside the respective wire loop downstream of the nozzle in the wire traveling direction, and the free section.

12 Claims, 1 Drawing Sheet

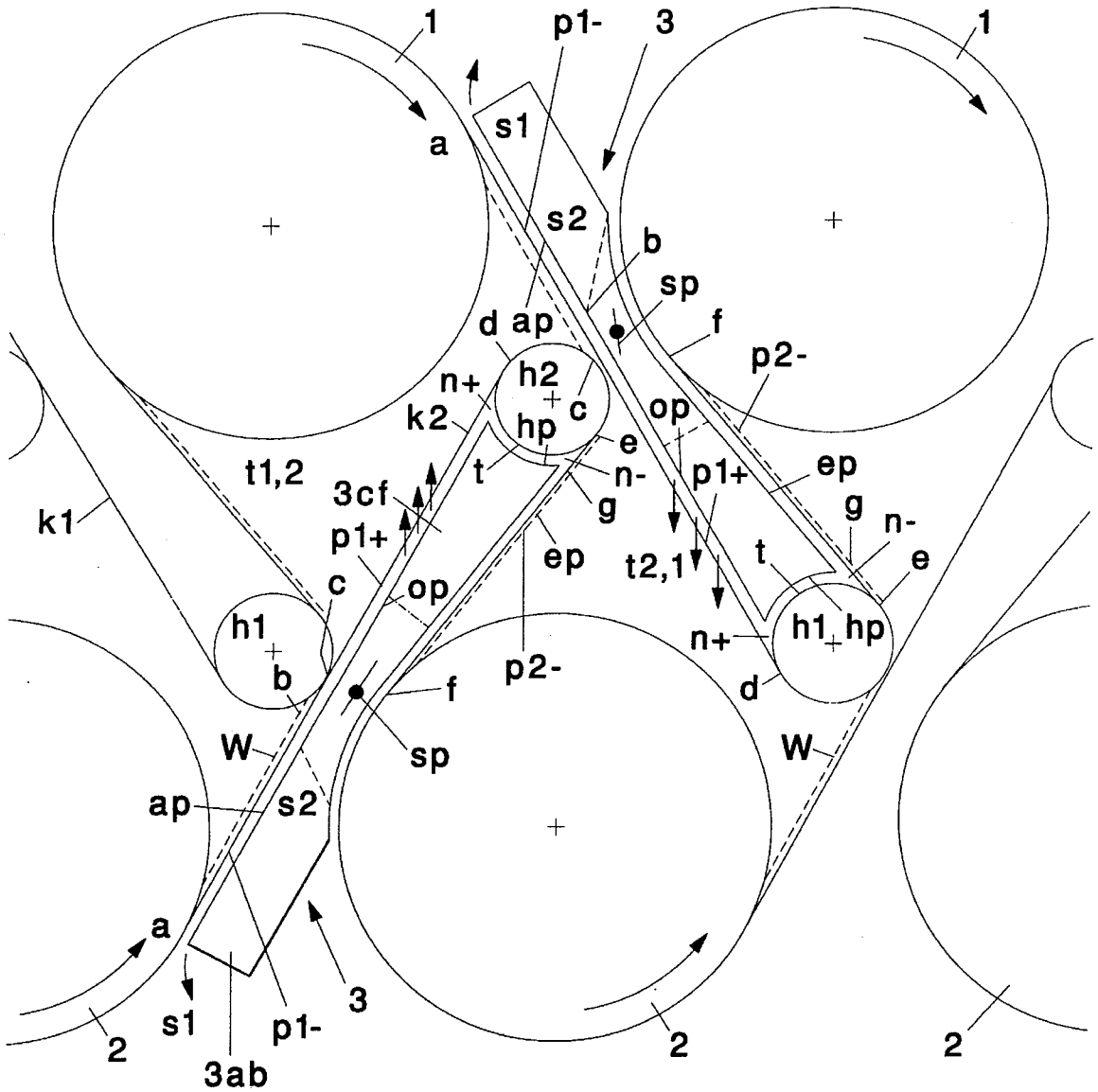
1
1
3
p1-
s1
s2
a
b
sp
f
p2-
ap
d
h2
c
op
p1+
e
n-
g
ep
hp
t
n+
k2
3cf
t1,2
h1
t2,1
k1
2
2
2
W
3
3ab
p1-
s1
a
ap
s2
b
h1
c
p1+
op
sp
f
p2-
ep
g
n-
e
hp
d
n+
t

METHOD AND DEVICE FOR ENSURING THE RUN OF THE WEB IN THE MULTI-CYLINDER DRYER OF A PAPERMACHINE

BACKGROUND OF THE INVENTION

The present invention relates to a method for ensuring the run of the web in the multi-cylinder dryer of a papermachine. The invention relates also to a device for carrying out the above method.

The multi-cylinder dryers of a papermachine have employed a so-called twin-wire run at the downstream end of a drying section. In the twin-wire run, the wire is supported against the jackets of cylinders included in two tiers of cylinders by means of two wires, one running along a tortuous path against the jackets of cylinders of an upper tier and the other against the jackets of cylinders of a lower tier. When passing over from one tier of cylinders to the other, the web travels unsupported. At machine speeds of more than 800 m/min, the air currents produced by the web and moving parts of the machine cause fluttering of the web in these open spaces. The fluttering leads to web breakups at the upstream end of such cylinder arrays, as the strength characteristics of the web are still poor due to a high water content.

Efforts have been made to resolve this problem by using a single-wire run, wherein the open runs of a web are eliminated and the web travels supported all the time by one and the same dryer wire between cylinders included in two tiers. The drying effect of those single-tier cylinders, whereat the wire at this point lies between the web and the cylinder, is negligible as the wire prevents the transfer of heat from the cylinder to the web. Indeed, in the most recent machines, such cylinders have been replaced with suction or vacuum rolls, and this has resulted in improved machine operating characteristics and the threading ropes have become unnecessary.

Originally, the single-wire groups generally used to comprise just two or three upstream drive groups of a machine, but their number has been increased as the machine speeds have increased. Some recent machines lack completely the twin-wire cylinder groups. A drawback in a single-wire run is the increased length of a dryer section, leading to the increased length of a machine hall and, thus, to the increased factory building costs. On the other hand, a drawback affecting the paper quality is that, in a single-wire run, heat is always supplied to the web from the same side of paper, resulting in possible defects in paper (curling).

As a summary of the above alternatives, it can be said that the benefits of a twin-wire run include two-sided drying operation and a short dryer section, but the drawbacks include poorer running characteristics at high machine speeds. The advantages and disadvantages of a single-wire run are essentially opposite relative to the above.

In addition, for example U.S. Pat. No. 3,753,298 discloses a machine configuration, which employs a twin-wire run but in which the web is all the time supported by either one of the dryer wires. This is achieved by passing the dryer wires by way of guide rolls mounted between the dryer cylinders in such a manner that, during the passage between a dryer cylinder and a guide roll, the dryer wire always runs tangentially to the other guide roll and the other dryer wire wrapping there around, whereby the web can be transferred from one dryer wire to another at these points without open draws. A weakness of the solution disclosed in the cited publication is that the run of a web against a dryer wire between dryer cylinders and wire guide rolls is not secure. Thus, the pressure differences prevailing in pockets defined by dryer cylinders and wire sections, the air currents produced thereby and, on the other hand, the adhesion forces between the web and cylinder surfaces detach the web from the dryer wires. Thus, the open, unsupported web is again susceptible to wrinkling and, at sufficiently high running speeds, this again leads to web breakups.

Naturally, attempts have been made to improve the operating characteristics of such a machine configuration by providing multi-cylinder dryers with air current controlling and/or producing structure at suitable locations. This type of solutions have been disclosed for example in Finnish Patents 68279 (Patent Application 841167) and 76142 (Patent Application 854494). The passage of the web against the dryer wire is secured by using vacuum developing blow boxes. However, the blow box assemblies and nozzle designs proposed in the above references require very large overall air quantities for a desired effect. These air quantities are typically about 2000–2400 $m^3/h$ per pocket. In terms of energy efficiency, this is undesired and leads to very large diameters in compensation air manifolds as well as highly complicated and expensive air circulation systems.

SUMMARY OF THE INVENTION

An object of the invention is to provide a method and a device for effecting the above type of closed twin-wire run with a web supported at all times in a manner that the amount of air can be minimized. According to a method of the invention, is an air guiding surface located on the other side of the dryer wire and opposite to the pocket allows to blow air from the nozzle into the pocket effectively and without large amounts of air. On the other hand, a device for carrying out the method includes a guiding surface mounted on the other side of the dryer wire in conjuction with the nozzle and opposite to the pocket for guiding an air current blown from the nozzle through the dryer wire and into the pocket.

BRIEF DESCRIPTION OF THE DRAWING

The invention will now be described in more detail with reference made to the accompanying drawing, which shows a side view of a multi-cylinder dryer included in a papermachine and provided with a device for utilizing the invention.

DESCRIPTION OF THE PREFERRED EMBODIMENTS

As for its general configuration, a multi-cylinder dryer shown in the drawings is similar to that disclosed in the above-cited U.S. and FI Patents. The multi-cylinder dryer comprises cylinders 1 included in a first tier of cylinders and cylinders 2 included in a second tier of cylinders, these being heated cylinders intended for removing water from a web W to be dried, and traveling in close conformity therewith under the guidance of dryer wires. A first dryer wire k1 travels in a tortuous path around top cylinders making up the first tier of cylinders. The web W travels supported by the wire k1 and always pressed against the jacket of each cylinder 1. Between the cylinders, the wire is passed around guide rolls h1 located below the cylinders, the position of these rolls being such that the loops formed by the wire and the web pass around the rolls obliquely relative to the longitudinal direction of the first tier of cylinders. In a corresponding fashion, the web W is passed around the jackets of cylinders 2, in this case the bottom cylinders, included in the second tier of cylinders, supported by a second dryer wire k2, this wire being passed around guide rolls h2 included in the second tier of cylinders such that the loops formed by the wire at this point are directed obliquely relative to the longitudinal direction of the second tier of cylinders in the same direction as the loops formed by the first dryer wire k1. In order to support web W over the entire distance, the loops formed by different dryer wires k1, k2 are arranged to run tangentially to each other such that over the section, wherein second dryer wire k2 travels from cylinder 2 to guide roll h2, it will run tangentially to the guide roll h1 of first dryer wire k1, whereby the web W extending from the jacket of the cylinder 2 can be transferred to the loop of wire k1 running around guide roll h1 for carrying it further to the jacket of first cylinder 1. Since a wire loop located downstream of this cylinder in the web traveling direction runs in turn tangentially to guide roll h2 of that wire loop from which the web was transferred, it can be transferred again back to second dryer wire k2 for carrying it to a second-tier cylinger 2. In order to secure the transfer, the wire guide rolls h1 and h2 are suction rolls.

The first dryer cylinder 1, a section of first dryer wire k1 extending from guide roll h1 to this cylinder, as well as a wire section leaving cylinder 1 and located between the cylinder and the guide roll h2 of second dryer wire k2 define together with the second dryer wire k2 a closed pocket t1,2. A corresponding pocket t2,1 is formed at the second cylinder 2.

The invention will now be described with reference made to equipment associated with the loop formed by the second dryer wire k2 winding on guide roll h2, but the same applies analogically also to equipment associated with the loop of the first dryer wire k1. Both of these loops include three sections having identified functions and being therefore designated with identical reference signs in both loops: a section a-c, wherein the wire runs along with web W from the cylinder to the location of wire guide roll, at which the wed is transferred to the dryer wire passing therearound, a section c-d, wherein the wire starting from the transfer point c progresses to the wire guide roll, as well as a section e-f, wherein the wire carrying the web W transferred back travels from guide roll to dryer cylinder.

At the loop formed by second dryer wire k2, along a section a-d between dryer cylinder 2 and guide roll h2, is mounted a nozzle s2 is mounted, located on the opposite side of wire k2 relative to pocket t1,2. The nozzle is intended for blowing air into pocket t1,2 for its ventilation and for securing the stability of web W over the sections of first dryer wire k1 defining the pocket, the nozzle having the same basic purpose as the nozzles disclosed in the above-cited Finnish Patents 68279 and 76142. Downstream in the traveling direction of dryer wire k2 the nozzle s2 is followed by an air guiding surface op, facing a wire section c-d. The air blown from nozzle s2 is guided along this section into a space between wire k2 and surface op, which space will thus be over-pressurized and this plenum zone is indicated with reference character pl+. The air guiding surface, which extends roughly parallel to section c-d, covers most of the length of this section, extending preferably to the proximity of the jacket of wire guide roll h2. In the drawing, the surface extends all the way to the gap between the wire and the roll, i.e. it extends beyond a plane tangential to the roll jacket and is perpendicular to wire k2. Thus, the gap n+ between dryer wire k2 and roll h2 located upstream of point d will also be over-pressurized. In view of intensifying the gap over-pressure, a sealing t is fitted between the jacket of guide roll h2 and an arched surface hp facing the roll jacket and adjoining the end of air guiding surface op and the roll jacket. The blowing air travels from plenum space p1+, n+ limited by wire k2 into pocket t1,2 through the air-permeable section c-d of dryer wire k2 not covered by web W, taking care of ventilation of the pocket.

The nozzle s2 is located in the traveling direction of dryer wire k2 upstream of point c, at which web W is transferred from second dryer wire k2 to first dryer wire k1. The location, at which the plenum zone between the dryer wire and the guiding surface begins, is indicated with reference character b and it is located upstream of point c. In the dryer wire traveling direction, upstream of point a, at which the dryer wire departs from cylinder 2, a nozzle s1 is located for producing an air blow directed against the wire traveling direction. Thus, between nozzles s1 and s2 within the section a-b there is provided a vacuum zone p1−. The development of this vacuum is assisted by a surface ap, located between nozzles s1 and s2 and facing section a-b. The vacuum zone can be used for sucking web W into the contact with dryer wire k2 over section a-b. Since the vacuum zone terminates upstream of point c, the transfer of web W from one wire to another is facilitated.

The nozzle s2 directed in the traveling direction of second dryer wire k2 has two functions, namely serving as an ejector nozzle producing vacuum within a zone limited directly by section a-b of the wire as well as an over-pressure within section c-d and especially in gap n+ between dryer wire k2 and guide roll h2, for taking care of pocket ventilation as the blowing air finds its way into pocket t1,2.

In practice, the nozzles s1 and s2, vacuum surface ap, and air guiding surface op can be simply formed such that the surfaces ap and op are provided by the dryer wire k2 facing side of a common air-blowing box 3 located inside the wire loop, whereby nozzle s2 opens on the side between surfaces ap and op and nozzle s1 is located at the end of the box upstream of point a, at which the wire and the web depart from dryer cylinder 2.

Within the section e-f, wherein the dryer wire k2 progresses from guide roll h2 to cylinder 2 together with web W received thereon at guide roll h2, there is in turn created another vacuum zone p2− on the other side of the dryer wire relative to pocket t2,1. This vacuum zone is produced by arranging an ejector surface ep inside the dryer wire loop opposite to the wire. Between the ejector surface and the wire within this zone there is induced a vacuum, since the wire has a tendency of grabbing air therealong when traveling at a high speed. In order to intensify the vacuum, the ejector surface ep forms an angle with the wire which can be in the order of 0°–15°, opening slightly in the wire traveling direction. The vacuum zone extends in the direction opposite to the wire traveling direction all the way to gap n- between the jacket of guide roll h2 and the wire section e-f. In order to intensify the gap vacuum, the ejector surface ep extends in this direction all the way to the gap, for example beyond a plane tangential to the jacket of guide roll h2 and perpendicular to wire k2, wherein it is joined at point g by the arched surface hp following the jacket of roll h2. As shown in the drawing, the ejector surface ep is constituted of the wire section e-f facing side of the same air-blowing box, which also includes vacuum surface ap and air guiding surface op. The arched wall, connecting air guiding surface op and ejector surface ep and facing the jacket of guide roll h2, is provided with the above-mentioned sealing t which, at the same time, separates gaps n+ and n− as well as the respective plenum and vacuum zones from each other.

Thus, a single air-blowing box located inside the dryer wire loop, by means of a proper design of its sides, can be used for producing both the vacuum zone p1- for securing the adherence of web W to the wire over section a-b, the plenum zone p1+, n+ taking care of the ventilation of pocket t1,2, as well as the vacuum zone p2–, n– for securing the adherence of web W to dryer wire k2 or k1 upon its transfer from the zone of action of the suction-equipped guide roll h2 or h1 at point e to be supported by the wire k2 or k1 within section e-f. In addition, it should be appreciated that the plenum zone p1+, n+ for providing the ventilation of pocket t1,2 or t2,1 also improves the adherence of web W to the dryer wire within sections which define the corresponding pocket and are located immediately upstream and downstream of dryer cylinder 1 or 2.

The edges of vacuum zones p1– and p2– can be provided with known edge blows for preventing the flow of leakage air from the surroundings at the wire edges into the vacuum zone.

The air-blowing box 3 conceivably comprises an air-blowing part 3*ab*, which receives blow ducts and is provided with nozzles s1 and s2, as well as an air guiding part 3*cf* mounted thereon and including air guiding surfaces op and an ejector surface ep as well as surface hp connecting them. Due to the configuration of a papermaking machine these parts can sometimes be separate parts, which, when positioned successively, provide the above assembly inside the wire loop.

Furthermore, the drawing illustrates how to arrange between the blowing part and the air guiding part a flow regulator, such as a damper plate sp, capable of regulating the amount of air flowing from nozzle s2 through dryer wire k2 into pocket t1,2. The damper plate is located in a flow duct that connects the surface downstream of nozzle s2 with ambient air. When the damper plate is open, some of the amount of air entering in the air-blowing part is allowed to flow out. When the damper plate is closed, all the air flows from the nozzles which are in communication with the air-blowing part. In cross-wire direction, the box can be further provided with a plurality of damper plates that can be adjusted for affecting the distribution of air in lateral direction.

I claim:

1. A method for ensuring the run of the web in the multi-cylinder dryer of a papermachine, including a first tier of cylinders for passing therealong a web supported by a first dryer wire on the cylinders included in the first tier of cylinders, as well as a second tier of cylinders for passing therealong the web supported by a second dryer wire on the cylinders included in the second tier of cylinders, wherein the first dryer wire travels around a first wire guide roll between the cylinders of the first tier of cylinders and the second dryer wire travels around a second wire guide roll between the cylinders of the second tier of cylinders such that, upon passing around the first wire guide roll, said first dryer wire forms a loop having at least one section, along which said first dryer wire is free of the web and which in the wire travelling direction is immediately upstream of a point, at which said first dryer wire is received on the first wire guide roll, said method including the steps of:

mounting a first nozzle along a first dryer wire section between the cylinder of the first tier and the first wire guide roll inside the first dryer wire loop for blowing air through the free section of the first dryer wire for ventilating a pocket formed between the free section and a cylinder included in the second tier of cylinders;

forming a plenum zone between an air guiding surface located inside the wire loop downstream of said first nozzle in the traveling direction of the first dryer wire, and the free section; and blowing said air from said first nozzle into said pocket through said plenum zone.

2. A method according to claim 1, wherein said air is blown from said first nozzle upstream of an initial point of the free section as seen in the traveling direction of the first dryer wire.

3. A method according to claim 2, wherein the first dryer wire section between the dryer cylinder included in the first tier of cylinders and the first wire guide roll includes an initial section, along which said web travels upon the first dryer wire, wherein the web is transferred at the end of the initial section on the second guide roll of the second dryer wire, and wherein said method further includes providing, in the first dryer wire traveling direction upstream of said first nozzle, a second nozzle for blowing air against the traveling direction of the first dryer wire for producing a vacuum zone delimited by the first dryer wire between said first and second nozzles along the first part of the initial section.

4. A method according to claim 3, wherein said plenum zone and said vacuum zone are created between a first dryer wire facing side of an air-blowing box inside the first wire loop and the first dryer wire, and wherein said first nozzle is located on said side at the boundary of said vacuum zone and said plenum zone.

5. A method according to claim 1, further including the step of sealing the plenum zone between the air guiding surface and the first dryer wire at the end next to the first guide roll by means of a seal fitted between the guide roll jacket and a surface limiting the plenum zone.

6. A method according to claim 1, further including the step of providing a section of the first dryer wire located downstream of the first guide roll in the traveling direction of the first dryer wire between the first guide roll and a dryer cylinder included in the first tier of cylinders inside the wire loop, with a vacuum zone directly limited by the first dryer wire and an ejector surface facing said wire section.

7. A device for ensuring the run of the web in the multi-cylinder dryer of a papermachine, including a first tier of cylinders including a first dryer wire for supporting a web at and between the cylinders of the first tier of cylinders as well as a second tier of cylinders including a second dryer wire for supporting the web at and between the cylinders of the second tier of cylinders, a first wire guide roll, around which the first dryer wire is adapted to travel between the cylinders of the first tier of cylinders and a second wire guide roll, around which the second dryer wire is adapted to travel between the cylinders of the second tier of cylinders, whereby said first dryer wire passing around the first wire guide roll forms thereat a loop having at least one section, along which the wire is free of the web and which in the web traveling direction is immediately upstream of a point, at which the wire is received on the first wire guide roll, said device including:

a first nozzle mounted along a section of the wire between the cylinder of the first tier of cylinders and the first wire guide roll inside the dryer wire loop, said nozzle being directed such that the air blown by it travels through the free section of the first dryer wire for ventilating a pocket formed between it and a cylinder of the second tier of cylinders, and in the traveling direction of the first dryer wire inside the wire loop, said first nozzle being followed by an air guiding surface and a plenum zone formed between the air guiding surface and the free section.

8. A device according to claim 7, wherein, as seen in the traveling direction of the first dryer wire, said first nozzle is located upstream of an initial point of the free section.

9. A device according to claim 8, wherein a section between the first dryer cylinder and the first wire guide roll comprises an initial section wherein the web is adapted to travel on the first dryer wire, the end of the initial section having a transfer point for transferring the web onto the second dryer wire traveling on the cylinders of the second tier of cylinders, and wherein in the traveling direction of the first dryer wire upstream of said first nozzle, there is a second nozzle directed against the traveling direction of the first dryer wire and between the first and second nozzles a vacuum zone is formed limited by the first dryer wire.

10. A device according to claim 9, further comprising an air-blowing box located inside the wire loop of the first dryer wire, said plenum zone and said vacuum zone being located between the side of said air-blowing box facing the first dryer wire and the first dryer wire, and said first nozzle being located on said side at the boundary of said plenum and vacuum zones.

11. A device according to claim 7, wherein the plenum zone between the air guiding surface and the first dryer wire is limited at the end next to said first guide roll by a seal fitted between the guide roll jacket and a surface limiting said plenum zone.

12. A device according to claim 7, wherein an ejector surface is located inside the wire loop of the first dryer wire opposite to a section of the first dryer wire located downstream of the first guide roll in the traveling direction of the first dryer wire between the guide roll and a dryer cylinder included in the first tier of cylinders, as well as a vacuum zone directly limited by the first dryer wire within said section inside the wire loop.

* * * * *